US010923093B1

(12) United States Patent
Micek

(10) Patent No.: US 10,923,093 B1
(45) Date of Patent: Feb. 16, 2021

(54) UNIVERSAL PICKUP TRANSDUCER MOUNTING SYSTEM

(71) Applicant: Petr Micek, Baltimore, MD (US)

(72) Inventor: Petr Micek, Baltimore, MD (US)

( * ) Notice: Subject to any disclaimer, the term of this patent is extended or adjusted under 35 U.S.C. 154(b) by 0 days.

(21) Appl. No.: 16/692,184

(22) Filed: Nov. 22, 2019

Related U.S. Application Data

(60) Provisional application No. 62/776,775, filed on Dec. 7, 2018.

(51) Int. Cl.

| | |
|---|---|
| ***G10H 3/18*** | (2006.01) |
| ***G10D 1/08*** | (2006.01) |
| ***G10D 3/06*** | (2020.01) |
| ***G10D 1/02*** | (2006.01) |

(52) U.S. Cl.
CPC ..... *G10H 3/181* (2013.01); *G10D 1/02* (2013.01); *G10D 1/085* (2013.01); *G10D 3/06* (2013.01); *G10H 3/182* (2013.01); *G10H 2220/505* (2013.01)

(58) Field of Classification Search
CPC ..... G10H 3/181; G10H 1/32; G10H 3/183; G10H 2220/505; G10H 3/182; G10H 2220/485; G10H 2220/495; G10H 2220/515; G10H 2220/501; G10H 2220/511; G10D 1/085; G10K 15/04; G10K 11/02; G01H 11/00; G01H 11/08
See application file for complete search history.

(56) References Cited

U.S. PATENT DOCUMENTS

| | | | | |
|---|---|---|---|---|
| 4,425,831 | A * | 1/1984 | Lipman | G10H 3/183 84/726 |
| 5,252,777 | A * | 10/1993 | Allen | G10H 3/182 84/726 |
| 5,767,432 | A * | 6/1998 | Randolph | G10D 1/085 84/267 |
| 5,929,362 | A * | 7/1999 | Oteyza | G10D 1/085 84/293 |
| 6,043,422 | A * | 3/2000 | Chapman | G10H 1/32 84/723 |
| 6,046,397 | A * | 4/2000 | Rose | G10H 3/182 84/743 |
| 6,111,184 | A * | 8/2000 | Cloud | G10H 3/182 84/723 |
| 6,911,590 | B2 | 6/2005 | Childress | |
| 8,829,318 | B1 * | 9/2014 | DeLaFrance | G10H 1/32 84/292 |
| 2003/0164080 | A1 * | 9/2003 | Childress | G10D 3/06 84/291 |

(Continued)

*Primary Examiner* — Marlon T Fletcher
(74) *Attorney, Agent, or Firm* — Rosenberg, Klein & Lee

(57) ABSTRACT

A universal pickup transducer mounting system for a string instrument having a neck and bridge between which a plurality of strings extend includes a receiving cavity formed in the string instrument's body and a multiplicity of exchangeable body blocks disposed in the receiving cavity and configured for releasable mounting therein. The multiplicity of exchangeable body blocks includes at least one transducer receiving block that has an opening formed therein configured for receiving at least one pickup transducer therein. The at least one transducer receiving block is mountable within the receiving cavity to locate the at least one pickup transducer at a user selected longitudinal position relative to the neck and the bridge.

13 Claims, 17 Drawing Sheets

(56) References Cited

U.S. PATENT DOCUMENTS

| | | | | |
|---|---|---|---|---|
| 2005/0211051 | A1* | 9/2005 | Petersen | G10D 1/085 84/290 |
| 2006/0054009 | A1* | 3/2006 | Redard | G10H 1/32 84/723 |
| 2008/0141841 | A1* | 6/2008 | Van Ekstrom | G10H 3/186 84/291 |
| 2008/0141851 | A1* | 6/2008 | Ekstrom | G10D 1/085 84/726 |
| 2009/0025543 | A1* | 1/2009 | Swartz | G10H 3/143 84/727 |
| 2009/0183626 | A1* | 7/2009 | Salehi | G10H 3/181 84/726 |
| 2011/0290099 | A1* | 12/2011 | Franklin | G10H 3/182 84/733 |
| 2012/0312146 | A1* | 12/2012 | Bekerman | G10H 3/143 84/726 |
| 2014/0373703 | A1* | 12/2014 | Whorton | G10D 1/085 84/743 |
| 2015/0059560 | A1* | 3/2015 | Perea Torres | G10H 3/18 84/726 |

* cited by examiner

UNIVERSAL PICKUP TRANSDUCER MOUNTING SYSTEM

CROSS-REFERENCE TO RELATED APPLICATIONS

The present disclosure claims priority from U.S. provisional patent application No. 62/776,775, filed Dec. 7, 2018, the entirety of which is hereby incorporated by reference.

BACKGROUND OF THE INVENTION

This disclosure directs itself to a system for mounting pickup transducers in a string instrument. In particular, the disclosed mounting system permits the number and/or type of pickup transducers to be selectively installed in the string instrument and subsequently changed to a different number of pickup transducers and/or types of pickup transducers. Further, the disclosed mounting system includes a multiplicity of exchangeable body blocks configured for releasable mounting within a receiving cavity formed in the body of the string instrument. More in particular, at least one of the exchangeable body blocks is a transducer receiving block. The transducer receiving block has an opening that is configured for receiving at least one pickup transducer of a particular type. Still further, the multiplicity of exchangeable body blocks may include at least one spacer block configured to fill at least one space within the receiving cavity of the string instrument. Additionally, any portion of transducer receiving blocks and/or spacer blocks are replaceable by other transducer receiving blocks with a different number or type of pickup transducer and/or other spacer blocks.

Electric string instruments, such as electric guitars, electric basses, electric violins, etc., use at least one pickup transducer to convert the vibration of instrument's strings into electrical impulses. The most commonly used pickups use the principle of direct electromagnetic induction, although other types, such as piezoelectric, optoelectronic, acoustic, etc. are also in use to produce electrical impulses from the instrument's string vibrations. Because of their natural inductive qualities, all magnetic pickups tend to pick up ambient electromagnetic interference (EMI) from electrical power wiring in the vicinity of the electric string instrument, such as the wiring in a building. The EMI from a 50 or 60 Hz power system can result in a noticeable "hum" in the amplified audio output from the audio transducer, particularly with poorly shielded single-coil pickups. Double-coil "humbucker" pickups were invented as a way to overcoming the problem of unwanted ambient hum sounds. humbucker pickups have two coils arranged to be of opposite magnetic and electric polarity so as to produce a differential signal. As ambient electromagnetic noise affects both coils equally and since they are poled oppositely, the noise signals induced in the two coils are cancelled out. The two coils of a humbucker are often wired in series to give a fuller and stronger sound, but may be wired in parallel and still provide the hum-cancelling property of the series arrangement. The parallel arrangement results in a brighter sound, since it passes higher frequency components of the sound that would otherwise be suppressed in the series arrangement, but at the cost of a lower output voltage, as with a single-coil pickup.

The exemplary conventional electric string instrument 10*a* shown in FIG. 1, which is an electric violin 10*a*, uses a single pickup transducer 26. The electric violin 10*a* has an instrument body 16 to which the neck 14 is affixed and extends longitudinally therefrom. A fretboard 15 is mounted on the neck and the distal end of the neck terminates in a head 12 having a plurality of tuning pegs 13 disposed thereon. A bridge 11 is mounted to the instrument body 16 at a location longitudinally spaced from the neck for attachment of a plurality of strings 21 thereto. The plurality of strings 21 extend from the bridge 11 across the fretboard 15 to the tuning pegs 13. The plurality of strings 21, the vibrations of which are sensed by the pickup transducer 26 are anchored at the bridge and pass over the pickup transducer 26.

The electric guitar 10*b*, shown in FIG. 2, is another example of a conventional electric string instrument. The electric guitar 10*b* includes an instrument body 16 to which a pickguard 32 is mounted thereto and to which the neck 14 is affixed and extends longitudinally therefrom. A fretboard 15 is mounted on the neck and the distal end of the neck terminates in a head 12 having a plurality of tuning pegs 13 disposed thereon. A bridge 11 is mounted to the instrument body 16 at a location longitudinally spaced from the neck for attachment of a plurality of strings 21 thereto. The plurality of strings 21 are anchored to the bridge 11 and extend therefrom across the fretboard 15 to the tuning pegs 13. It is very common to utilize a pair of pickup transducers 26*a*, 26*b* on the modern electric string instrument 10*b*, one pickup transducer 26*a* located in proximity to the bridge 11 on the instrument body 16, and the other pickup transducer 26*b* in proximity to the end of the neck 14 where it is joined to the instrument body 16. The pickguard 32 may serve as a bezel for one or both of the pickup transducers 26*a*, 26*b*. In some electric guitars 10*b* a bezel 33 surrounds the bridge 11 and the adjacent pickup transducer 26*a*. A broad range and variation of sounds can be generated using multiple pickup transducers. The bridge 11, as an anchor point for the strings 21, limits the displacement of the strings adjacent thereto and thereby limits the production of lower frequency sound components detectable by a pickup transducer adjacent thereto. Thus, it is higher frequency components of the sound that are transduced by the pickup transducer 26*a* that is positioned in proximity to the bridge 11. The other pickup transducer 26*b*, on the other hand, is located in proximity to the proximal end of the neck 14, where the neck 14 is joined to the guitar 10*b*. As the pickup transducer 26*b* is relatively a substantial distance from the anchor points 11 and 13 of the strings 21, the strings 21 are able to vibrate with greater amplitude and thereby produce lower frequency components of the sound. Controls 25 are mounted on the instrument body 16 to control such functions as volume, tone, coil polarity, blending of the transducer outputs, transducer selection, etc. A control cover plate 31 may also be mounted to the body 16 to provide a desired aesthetic appearance for the guitar 10*b*.

Another conventional electric guitar variation is shown in FIG. 3. In FIG. 3, the electric guitar 10*c* includes an instrument body 16 to which a pickguard 34 is affixed. The pickguard 34 may serve as bezel for the pickup transducers 26, 28*a*, 28*b*, as well as for the controls 25, depending upon its configuration. The neck 14 is affixed to the instrument body 16 and extends longitudinally therefrom. A fretboard 15 is mounted on the neck and the distal end of the neck terminates in a head 12 having a plurality of tuning pegs 13 disposed thereon. A bridge 11 is mounted to the instrument body 16 at a location longitudinally spaced from the neck for attachment of a plurality of strings 21 thereto. The plurality of strings 21 are anchored to the bridge 11, and extend therefrom across the fretboard 15 to the tuning pegs 13. It is also very common to utilize three pickup transducers on a modern electric string instrument such as the guitar 10*c*, one pickup transducer 26 located in proximity to the bridge 11 on the instrument body 16, another pickup transducer 28*a* located in proximity to the end of the neck 14 where it is joined to the instrument body 16 and yet a third pickup transducer 28*b* located at a location intermediate the bridge and neck. The pickup transducers 28*a* and 28*b* in this example are humbucker type pickups. Each pickup transducer 28*a*, 28*b* has two pickup coils in a single package that are phased to provide cancellation of common mode signals which are made to be "out of phase" by the poling of the two pickup coils. This single package design makes them easy to use. Controls 25 are mounted on the instrument body 16 to control such functions as volume, tone, coil polarity, blending of the transducer outputs, transducer selection, etc.

As previously noted, the bridge 11 being an anchor point for the strings 21, limits the displacement of the strings 21 adjacent thereto, and thereby, higher frequency components of the sound are transduced by the pickup transducer 26, and to a lesser degree, depending on its distance from the bridge 11 the adjacent humbucker pickup transducer 28*b*. The other humbucker pickup transducer 28*a*, on the other hand, is located in proximity to the proximal end of the neck 14, the end of the neck where it joins the instrument body 16. As the neck region is relatively a substantial distance from the anchor points 11 and 13, of the strings 21, the strings 21 are able to vibrate with greater amplitude and thereby are able to produce lower frequency components of the sound.

The same basic string instrument, differing only in the use of different a number of pickup transducers, and/or a different type of pickup transducer, and/or variations in pickup transducer mounting locations relative to the anchor points of the strings, including orienting a portion of one or more pickup transducers so that individual string sensors for some strings are spaced form the string anchor points differently than other of individual string sensors thereof, produces different sounding instruments. Electric string instruments are typically manufactured to utilize a specific number and particular types of pickup transducers at predetermined locations.

While it is sometime possible to add additional pickup transducers by creating the necessary opening(s) in the instrument body, it is then not possible or at least, not practical to change the locations of the pickup transducers to adjust or later change the sound of the instrument. Similarly, while it is usually possible to enlarge a pickup transducer opening in the instrument body, it is generally not possible or at least, not practical to fill the enlarged opening intended for a humbucker pickup transducer or a pair of collocated or offset single coil pickup transducers to then accept a smaller single coil pickup transducer. Where a pickguard of the string instrument extends to and surrounds the pickup transducer opening to function as a bezel, replacement pickguards with differently configured openings may be provided to correspond to a change in size/configuration of one or more pickup transducer openings in the instrument body, where such is possible. However, changing the spacing of a pickup transducer relative to the end of the neck 14 where it is joined to the instrument body 16 is not easily accomplished, even with the availability of a "virgin" pickguard into which new openings can be formed.

Musicians often like to experiment with different sounding instruments or have preferences for particular sounding instruments for use with different genre of music. To accommodate this need, it has been common for such musician to own multiple electric string instruments of a particular type, each with a different pickup transducer configuration. While that solution works well for those musicians that frequently change between different sounding instruments, it is an expensive solution for those who change less frequently or who are just experimenting to find a preferred sound.

SUMMARY OF THE INVENTION

A universal pickup transducer mounting system for a string instrument is provided. The string instrument has a body, a longitudinally extended neck with a head at a first end thereof and an opposing second end connected to the body. A bridge is affixed to the body at a location longitudinally displaced from the second end of the neck, and a plurality of strings extend between the bridge and head, and are laterally spaced from one another. The mounting system includes a receiving cavity formed in the body that extends longitudinally therein, between the bridge and the second end of the neck. The receiving cavity is disposed in aligned relationship with the plurality of strings and has a width at least as wide as a lateral spacing between endmost strings of the plurality of strings and a length defined between opposing longitudinal ends thereof. Further, the mounting system includes a multiplicity of exchangeable body blocks disposed in the receiving cavity and configured for releasable mounting therein. The multiplicity of exchangeable body blocks includes at least one transducer receiving block that has an opening formed therein configured for receiving at least one pickup transducer therein. The at least one transducer receiving block is mountable within the receiving cavity to locate the at least one pickup transducer at a user selected longitudinal position relative to the second end of the neck and the bridge.

From another aspect, a method of making a string instrument with a universal pickup transducer mounting system is provided. The method includes providing an instrument body that has a neck mounting portion and a bridge mounting portion at a location longitudinally spaced from the neck mounting portion. The method further includes forming a longitudinally extended receiving cavity in the instrument body between the neck and bridge mounting portions. Further, the method includes providing a multiplicity of exchangeable body blocks configured for replaceable mounting within the receiving cavity. The multiplicity of exchangeable body blocks includes a plurality of transducer receiving blocks each having at least one opening formed therein for receiving at least one of a plurality of different pickup transducers therein. Still further, the method includes installing a pickup transducer in one of the transducer receiving blocks, and installing the one of the transducer receiving blocks at any of a plurality of positions within the receiving cavity to thereby locate the pickup transducer at a selected longitudinal spacing relative to the neck and bridge mounting portions.

From yet another aspect, a universal pickup transducer mounting system for an electric string instrument is provided. The electric string instrument includes an instrument body having a neck extending longitudinally from one end thereof and a bridge affixed to the body at a location longitudinally displaced from the neck. The mounting system includes a longitudinally extended receiving cavity formed in the instrument body at a location disposed between the neck and the bridge of the electric string instrument. Further, the mounting system includes a multiplicity of exchangeable body blocks configured for removable mounting within the receiving cavity. The multiplicity of exchangeable body blocks includes a plurality of transducer receiving blocks configured for receiving at least one type of a plurality of types of pickup transducers within an opening formed therein. A portion of the plurality of transducer receiving blocks is mounted within the receiving cavity at selected longitudinal positions relative to the neck and the bridge and relative to one another. Any of the mounted transducer receiving blocks is replaceable with other of the plurality of transducer receiving blocks configured for receiving a different type, number or combination of the type and number of pickup transducers.

Additionally, from still a further aspect, a universal pickup transducer mounting system for an electric string instrument is provided. The electric string instrument has an instrument body with a longitudinally extended cavity formed therein between a neck extending longitudinally from the instrument body and a bridge affixed to the instrument body at a location longitudinally displaced from the neck. The receiving cavity has a length defined between opposing longitudinal ends thereof. The mounting system includes a multiplicity of exchangeable body blocks configured for mounting within the cavity at user selected positions. The multiplicity of exchangeable body blocks includes a plurality of transducer receiving blocks configured for receiving at least one of a plurality of types of pickup transducers within an opening formed therein and a plurality of spacer blocks. At least one of a combination of a portion of the plurality of multiple transducer receiving blocks or a combination of at least one of the plurality of transducer receiving blocks and at least one of the plurality of spacer blocks are mounted within the cavity. Any of the multiplicity of exchangeable body blocks is at least replaceable with other of the exchangeable body blocks to change at least one of a type of pickup transducer disposed in cavity, a number of pickup transducers, a position of at least one pickup transducer relative to the bridge and proximal end portion of the neck, or a combination thereof.

DETAILED DESCRIPTION OF THE PREFERRED EMBODIMENTS

Figure 1:
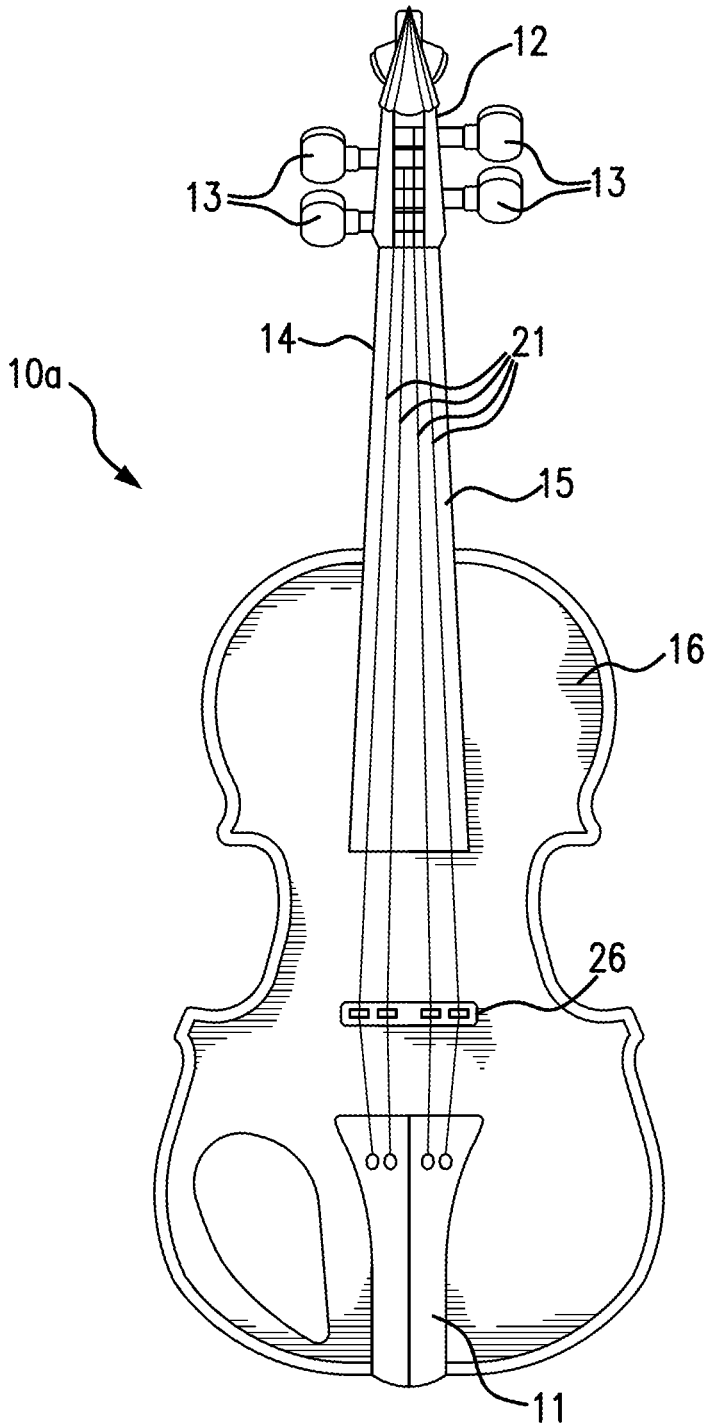
FIG. 1 PRIOR ART
FIG. 1 is a conventional exemplary electric string instrument that uses a single pickup transducer.
Figure 2:
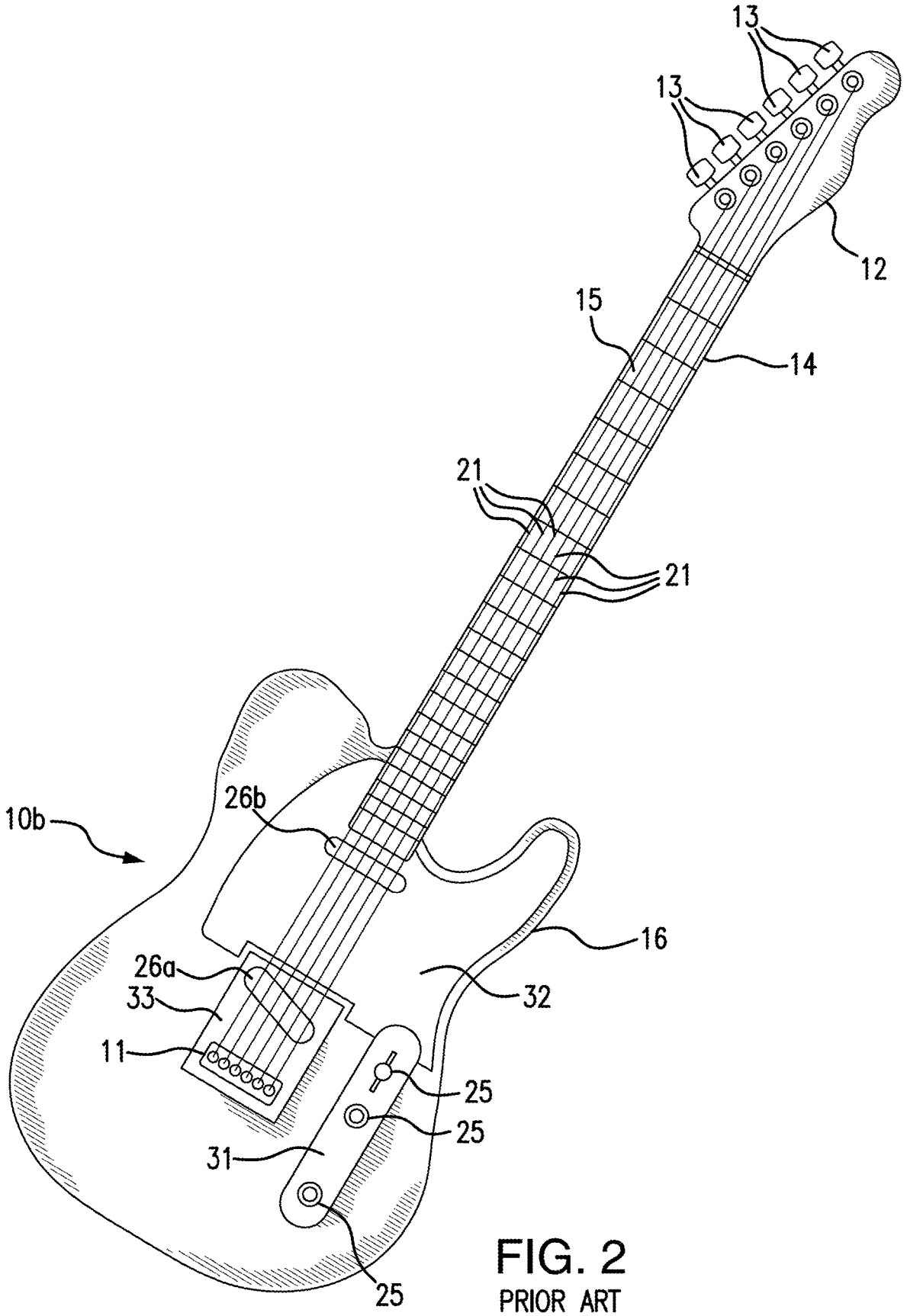
FIG. 2 PRIOR ART
FIG. 2 is a is another conventional exemplary electric string instrument showing a typical arrangement of a pair of pickup transducers.
Figure 3:
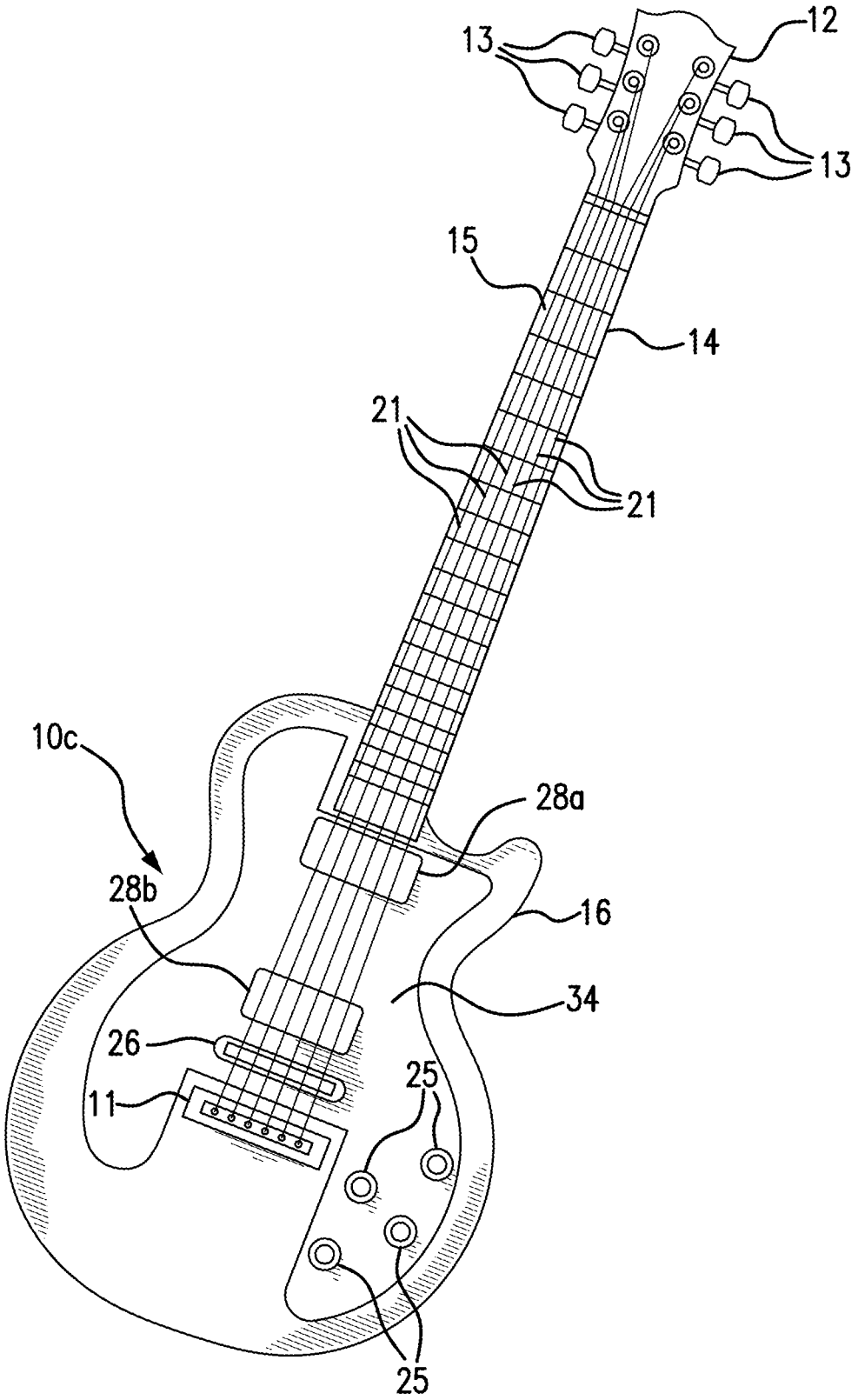
FIG. 3 PRIOR ART
FIG. 3 is a further conventional exemplary electric string instrument showing use of three pickup transducers.

Referring to FIGS. 4-16, there is shown universal pickup transducer mounting system 100 that provides a system whereby a selected number and types of pickup transducers 26, 28, and 29*a* and 29*b* are releasably and exchangeably mounted in an instrument body 160 at selected longitudinal positions with respect to the bridge 11 and a proximal end 30 of the neck 14 of an electric string instrument 10. While the pickup transducer 26, 28, and 29*a* and 29*b* interact with the strings 21 of the electric string instrument 10, shown in FIG. 1A, the arrangement of the strings 21 of the string instrument 10 described herein is conventional. For that reason, it is not believed necessary for the strings of the instrument to be described any further than the description previously provided with respect to the prior art, for achieving an understanding of the inventive concepts being disclosed herein.

The universal pickup transducer mounting system 100 includes a multiplicity of exchangeable body blocks 140 configured for mounting within a receiving cavity 110 formed in an instrument body 160. As will be described in following paragraphs, exchangeable body blocks 140 provide a unique arrangement of pickup transducer receiving blocks 120 and spacer blocks 130 to fill the receiving cavity 110 formed in the instrument body 160 in any of a multiplicity of pickup transducer configurations for the electric string instrument 10. A portion of the multiplicity of exchangeable body blocks 140 installed in the receiving cavity 110 may include at least one of any of a plurality of transducer receiving blocks 120. A portion of the multiplicity of exchangeable body blocks 140 installed in the receiving cavity 110 may further include at least one of any of a plurality of spacer blocks 130.

The unique arrangement of pickup transducer receiving blocks 120 and spacer blocks 130 further provides the ability to easily change pickup transducer configurations for the electric string instrument 10, including the ability to change the type and number of pickup transducers mounted within the receiving cavity 110. The type of pickup transducer, as used herein, is intended to encompass the sensing technology of the transducer, the sensor configuration and/or number of sensors of the transducer, and attributes of the transducer, including size, brand, color, electrical characteristics, and the like. The number of pickup transducers mounted within the receiving cavity 110 using the pickup transducer receiving blocks 120 is easily increased, limited only by the longitudinal extent of the receiving cavity 110, or decreased, replacing selected pickup transducer receiving blocks 120 with one or more of the spacer blocks 130. The spacer blocks 130 may be used to space a respective one of the pickup transducer receiving blocks 120 from the bridge end of the receiving cavity 110, from the neck end of the receiving cavity 110, from another of the pickup transducer receiving blocks 120, as well as used to fill the space of a respective one of the pickup transducer receiving blocks 120 that is being removed from the receiving cavity 110.

Figure 4:
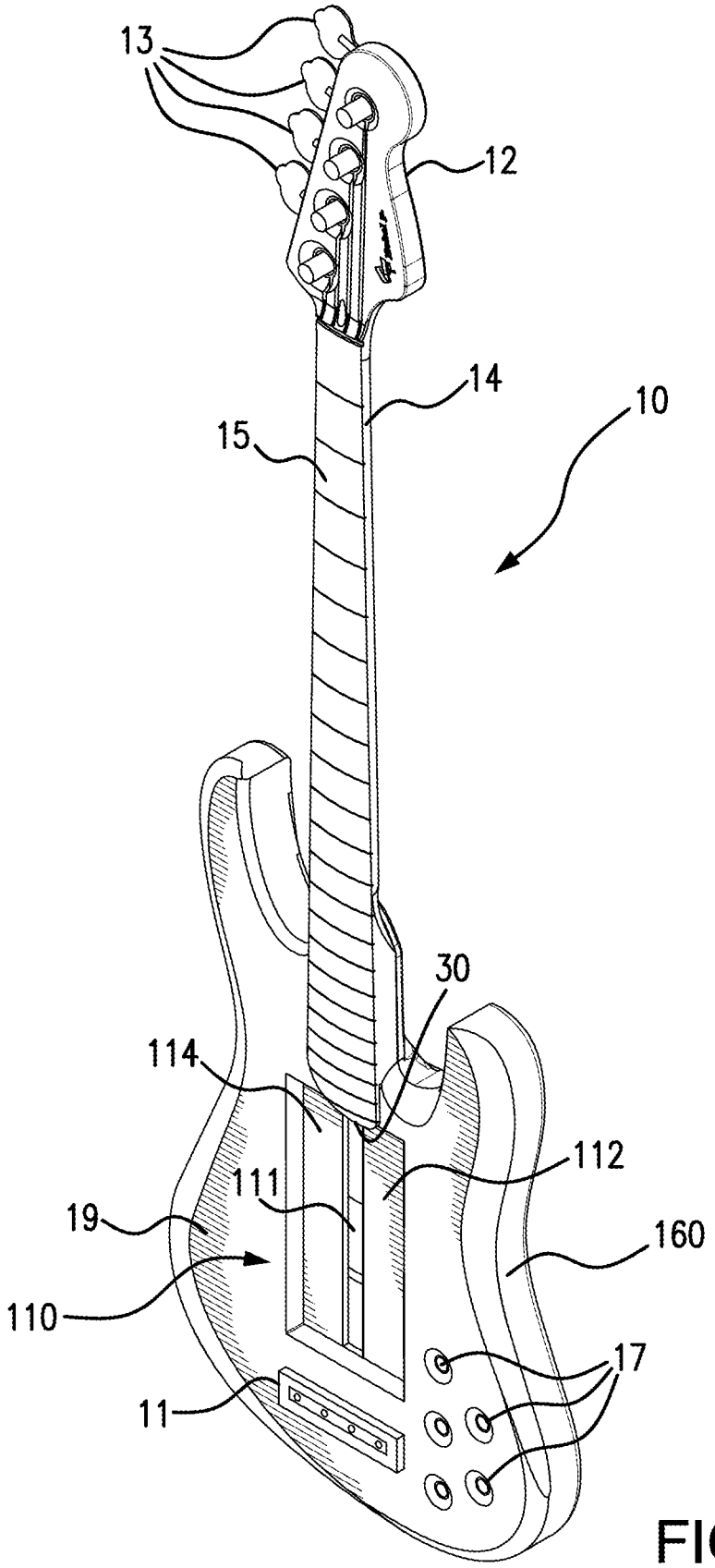
FIG. 4 is a front perspective view of a string instrument having an instrument body incorporating the receiving cavity of the present invention.
Figure 5:
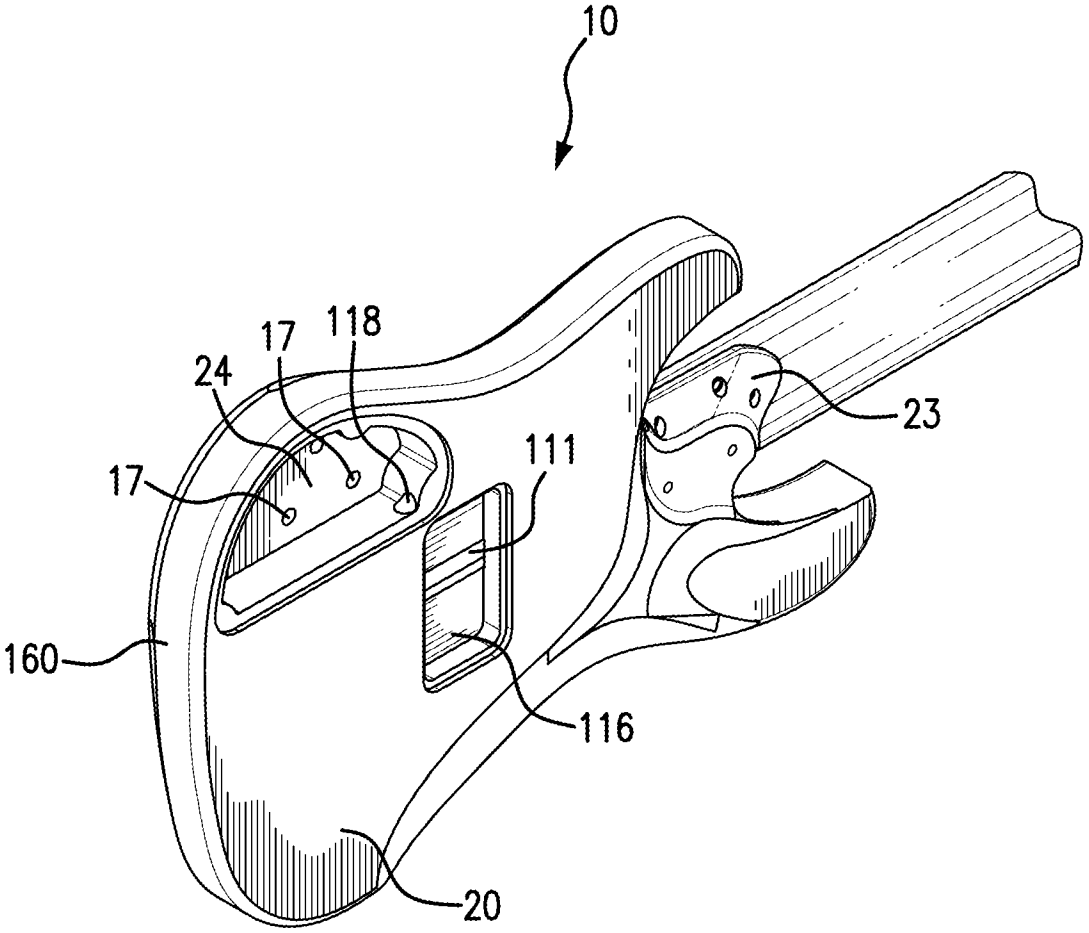
FIG. 5 is a rear perspective view of a string instrument having an instrument body incorporating the pickup transducer wiring cavity of the present invention.

As shown in FIGS. 4 and 5, the electric string instrument 10 is provided with an instrument body 160 to which a neck 14 is joined and extends longitudinally therefrom, as is conventional. At the distal end of the neck 14 there is a head 12 having a plurality of tuning pegs 13 for respective coupling to a plurality of strings, not shown. As is well known in the art, the strings extend over the fretboard 15, which overlay the neck 14, to the bridge 11, where they are respectively anchored. The proximal end portion 30 of the neck 14 is joined to the instrument body 160 at a neck mounting portion 23, also shown in FIG. 6. The instrument body 160 has a plurality of control mounting openings 17 formed in the front side 19 thereof and may be of various configurations, including hole and slots. The control mounting openings 17 are through holes extending from the front side 19 of instrument body 160 to a control cavity 24 formed in correspondence therewith in the rear side 20 of instrument body 160 and in which the control devices are disposed.

The instrument body 160 is formed with a receiving cavity 110 in the front side 19 thereof. Receiving cavity 110 extends longitudinally from a location adjacent to the proximal end portion 30 of the neck 14, to a location adjacent to the bridge 11, so that distance between the opposing ends thereof defines the length of the receiving cavity 110. The overall longitudinal extent of the receiving cavity 110 is dependent on the size of the instrument body 160 for the particular electric string instrument 10 and particularly the longitudinal distance between the location of the bridge mounting holes 15 and the neck mounting joint 23 of the instrument body 160, shown in FIG. 6. As some string instruments are manufactured with the instrument body 160 and neck 14 being integrally formed in one piece formation, the overall longitudinal extent of the receiving cavity 110 is dependent on the longitudinal distance between the location of the bridge mounting holes 15 and the proximal end portion 30 of the neck 14. The receiving cavity 110 has a width that is at least as wide as a lateral spacing between endmost strings of the plurality of strings that extend between the head of the neck 14 and the bridge 11. Within the receiving cavity 110 there is provided a pair of longitudinally extended mounting rails 112 and 114 in laterally spaced relationship. Between the mounting rails 112 and 114 there is disposed a wiring opening 111 through which the electrical connection wires of the pickup transducer(s) pass.

The rear side 20 of instrument body 160 has two cavities, the control mounting cavity 24 and a pickup wiring access cavity 116. The wiring opening 111 is a through opening that extends from the receiving cavity 110 to the pickup wiring access cavity 116. To accommodate electrical connections between the pickup transducer connection wiring that is passed from the receiving cavity 110 to the wiring access cavity 116, with the control devices disposed in the control cavity 24, a pickup wiring passage 118 is formed to extend between the wiring access cavity 116 and control mounting cavity 24 for connection to the appropriate control devices mounted therein. The controls, which provide such functions as volume, tone, coil polarity, blending of the transducer outputs, transducer selection, etc. are mounted so that their respective shafts or operating levers pass through the openings 17. Subsequent to the controls and pickup transduces being mounted and the wiring connections made, the cavities 24 and 116 are closed by corresponding removable cover plates, not shown.

Figure 6:
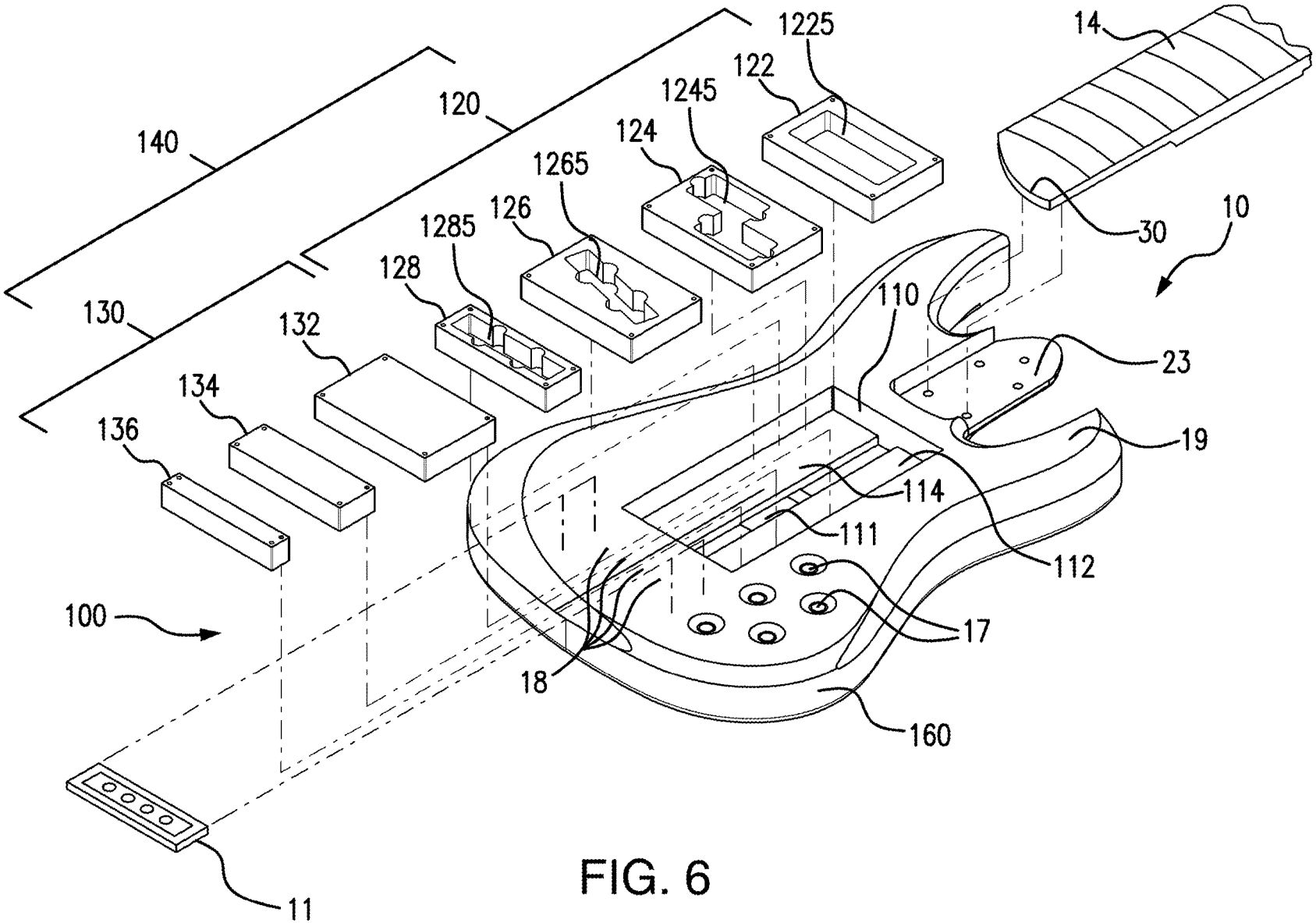
FIG. 6 is an exploded perspective view of a string instrument having an instrument body incorporating the present invention.

Universal pickup transducer mounting system 100, as shown in FIG. 6, includes a multiplicity of exchangeable body blocks 140, where at least a portion of the multiplicity of exchangeable body blocks 140 are selectively mounted in the receiving cavity 110 formed in the front side 19 of the instrument body 160. As is conventional, the bridge 11 is affixed to the front side 19 of the instrument body 160 through a plurality of bridge mounting holes 18 and fasteners (not shown). The instrument body 160 has a neck mounting portion 23 to which the neck 14 is joined conventionally by fasteners, not shown. Mounting rails 112 and 114 are formed within the receiving cavity 110 and support the exchangeable body blocks 140 therein and to which the exchangeable body blocks 140 may be affixed. Mounting rails 112 and 114 may be formed and any structurally appropriate material for support and/or securement of the exchangeable body blocks 140 thereto, such as wood, metal, plastic, composite materials including FR-4 epoxy glass laminate and carbon fiber laminates, as examples, and the like. The mounting rails 112 and 114 may be formed of the same material as that of the instrument body 160, and thereby may be formed integrally in one piece therewith. Otherwise, the mounting rails 112 and 114 are affixed to the instrument body 160 by conventional methods, such as through the use of fasteners, adhesives or any other structurally appropriate connection method.

As previously discussed, the longitudinally extended receiving cavity 110 is formed in the front side 19 of instrument body 160 in spaced relationship between the neck mounting joint 23 and the bridge mounting holes 18, resulting in the receiving cavity 110 being likewise longitudinally spaced between the proximal end portion 30 of the neck 14 and the bridge 11. For a string instrument 10, such as a guitar, it is common for at least three of the exchangeable body blocks 140 to be accommodated within the receiving cavity 110, depending on the size of string instrument 10 and the corresponding size of the receiving cavity 110.

The exchangeable body blocks 140 installed in the receiving cavity 110 may all be pickup transducer receiving blocks 120 or a combination of pickup transducer receiving blocks 120 and spacer blocks 130. However, it should be understood this disclosure encompasses system 100 having as few as a single exchangeable body block 140 installed in the receiving cavity 110 in the form of a pickup transducer receiving block 120, as well as encompassing multiple exchangeable body blocks 140 installed in the receiving cavity 110 that includes a single transducer receiving block 120 and may further include one or more spacer blocks 130. By the arrangement provided by universal pickup transducer mounting system 100, the mounting location, type, brand and/or technology of any mounted pickup transducer is easily changed and that change is just as easily reversed or subsequently changed further to a different mounting location, type, brand and/or technology of pickup transducer. Accordingly any of magnetic, piezoelectric, optoelectronic and the like pickup transducer can be easily interchanged without having to modify the physical structure of the instrument body 160.

The exchangeable body blocks 140 are selectively mountable within the receiving cavity 110 and include pickup transducer receiving blocks 120, and may further include spacer blocks 130. It should further be understood this disclosure encompasses system 100 having a multiplicity of exchangeable body blocks 140 that provides a greater number of exchangeable body blocks 140 than are mountable within the receiving cavity 110 to allow a user to reconfigure and or exchange the exchangeable body blocks 140. Thus, the number of pickup transducer receiving blocks 120 and/or spacer blocks may be of greater number then are mountable together within the receiving cavity 110.

Each of the pickup transducer receiving blocks 122, 124, 126, 128 respectively include a respective pickup receiving opening 1225, 1245, 1265, 1285 that is configured to mate with a particular type and/or brand of pickup transducer or number of pickup transducers. The transducer receiving blocks may also have an opening configured to accommodate alternative pickup transducer mounting configurations, such as an orientation of the pickup transducer with respect to the lateral span of the plurality of strings, as exemplified by pickup transducer receiving block 126 having an opening 1265 configured to incline the pickup transducer installed therein so that a pickup coil at one end thereof is closer to the bridge 11 or the proximal end portion 30 of the neck 14 than a pickup coil at the opposing end of that pickup transducer, as exemplified in FIG. 11. The pickup transducer receiving blocks 122, 124, 126, and 128 are exemplary, as are their respective openings illustrated herein. The pickup transducer receiving blocks 120 may include a large assortment of blocks, each with openings formed therein to accommodate one or more pickup transducers having other case configurations or orientations than those specifically illustrated herein, and which may be included in the assortment of pickup transducer receiving blocks 120 that are included in the multiplicity of exchangeable body blocks 140 of system 100.

Where the number of pickup transducer receiving blocks 120 being used do not fill all of the longitudinal space within the receiving cavity 110, one or more spacer blocks 130 are usable to fill the gaps adjacent the pickup transducer receiving blocks 120. Spacer blocks 130 may be provided in incremental widths, such as the wide spacer block 132 having a width equal to the widest of the pickup transducer receiving blocks 120, which may be the humbucker pickup transducer receiving block 122 or may be a receiving block 124 for a multiple pickup transducer arrangement, often referred to as an offset or split coil pickup transducer configuration. The widest spacer block 132 may be considered to be a "standard width" spacer block. The widest of the pickup transducer receiving blocks 120 may also be considered to be a "standard width" pickup transducer receiving block, which is of a width equal to that of the "standard width" spacer block. What could be considered a medium width spacer block 134 may be a half width spacer block (half the width a standard width spacer block 132), and the more narrow spacer block 136 may be a quarter width spacer block (one quarter the width of a standard width spacer block 132). These spacer block widths are exemplary and other incremental width sizes may be included in the assortment of spacer blocks 130 that may be included in the multiplicity of exchangeable body blocks 140 of system 100, or substitute for those exemplary spacer blocks disclosed herein.

Both the pickup transducer receiving blocks 120 and the spacer blocks 130 are removably mounted to the mounting rails 112 and 114 within the receiving cavity 110. Spacer blocks 130 are mounted within the receiving cavity 110 in the same manner as that of the pickup transducer receiving blocks 120. The pickup transducer receiving blocks 120 and the spacer blocks 130 may be provided with through holes for passage of fasteners therethrough to be engaged to the mounting rails 112 and 114. Such fasteners may be conventional threaded fasteners or quick release quarter-turn fasteners. Other securement devices that firmly, but releasably secure the exchangeable body blocks 140 to the mounting rails 112 and 114 directly or to intermediate members that are in turn coupled to mounting rails 112 and 114 may also be used. The exchangeable body blocks 140 may alternately be frictionally held within the receiving cavity 110 or compressively clamped therein by a trim plate (not shown) that frames the opening of the receiving cavity 110 and overlays end portions of the exchangeable body blocks 140.

As will be discussed in following paragraphs, Each of the different exemplary pickup transducer receiving blocks 122, 124, 126, and 128 may be provided with a corresponding plug 1222, 1242, 1262 and 1282 disposed in the corresponding opening 1225, 1245,1265 and 1285 into which the transducer is to be installed. The plug 1222, 1242, 1262 and 128 is held within the respective opening by at least one breakaway tab, so that the plug is easily removed prior to installation of the associated pickup transducer therefor and installation of the pickup transducer receiving blocks 122, 124, 126, and 128 in the receiving cavity 110. The exemplary assortment of pickup transducer receiving blocks 120 with the plugs removed are shown in FIG. 6.

Figure 7:
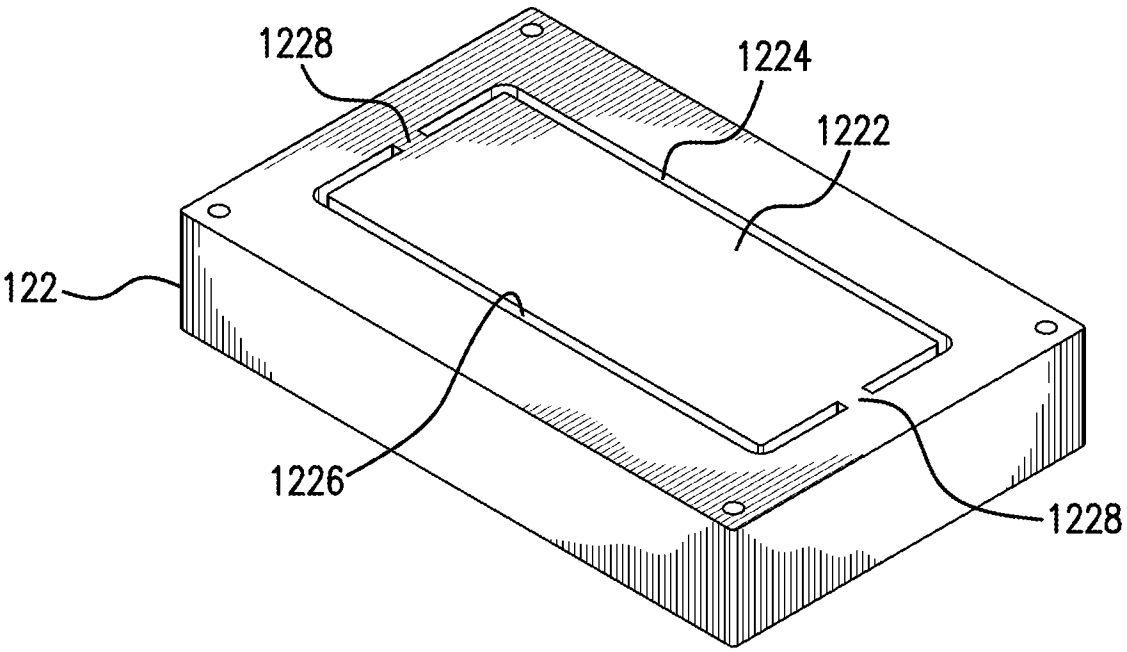
FIG. 7 is a perspective view of an exemplary pickup transducer receiving block of the present invention.

FIG. 7 shows the pickup transducer receiving block 122, which may be used with a humbucker type magnetic pickup transducer. The block is formed with a plug 1222 disposed in the opening 1225 into which the pickup transducer will be installed. The plug 1222 is held with in the opening by at least one breakaway tab 1228. In the exemplary embodiment shown, there is provided a pair of breakaway tabs 1228 that remains after the perimeter slotted openings 1224 and 1226 are formed. The perimeter slotted openings 1224 and 1226 are through openings and may be formed using a laser cutting process or by mechanical cutting tools. The one or more breakaway tabs 1228 are formed with a relatively small cross-sectional area to permit the plug 1222 to be easily separated therefrom by application of a torque to the plug 1222 or use of a tool inserted in the at least one of the slotted openings 1224 and 1226 to pry or otherwise displace the plug 1222.

Figure 8:
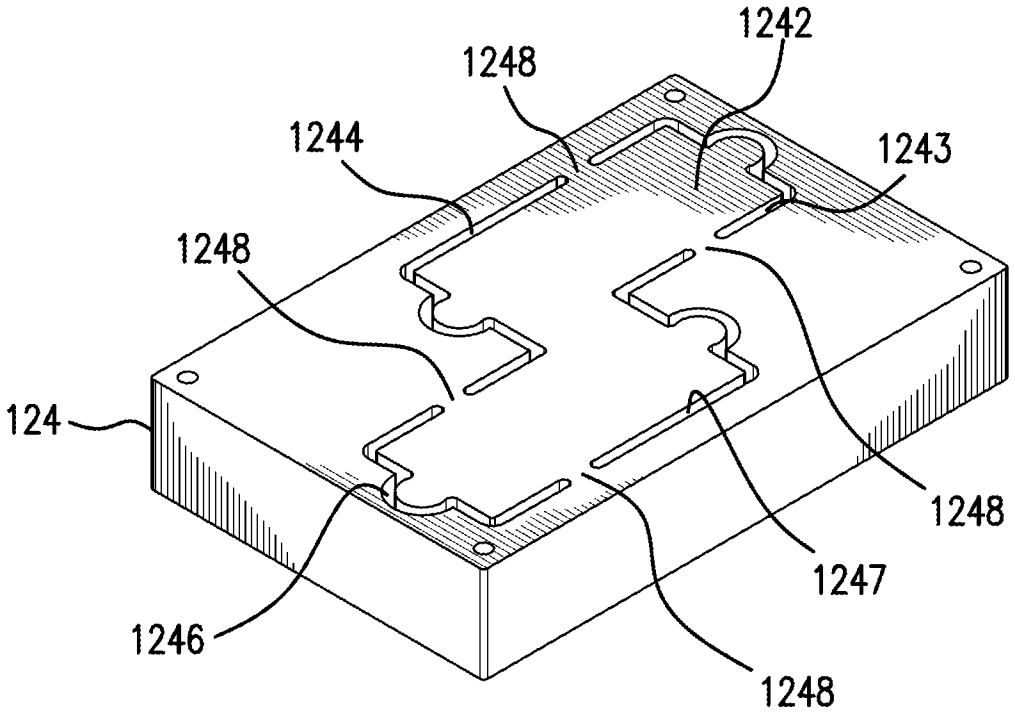
FIG. 8 is a perspective view of another exemplary pickup transducer receiving block of the present invention.

Referring now to FIG. 8, there is shown pickup transducer receiving block 124 for use with a pair of pickup transducers, one being laterally offset with respect to the other. The pickup transducer receiving block is formed with a plug 1242 disposed in the opening 1245 into which the pair of pickup transducers will be installed. As a result of its size, the plug 1242 may be held with in the opening by a plurality of breakaway tabs 1248 that are respectively formed by discontinuously forming the perimeter slotted openings 1243, 1244, 1246 and 1227 so that the breakaway tabs 1248 remain. The perimeter slotted openings 1243, 1244, 1246 and 1247 are through openings and may be formed using a laser cutting process or by mechanical cutting tools. Hereto, breakaway tabs 1248 are each formed with a relatively small cross-sectional area to permit the plug 1242 to be easily separated therefrom.

Figure 9:
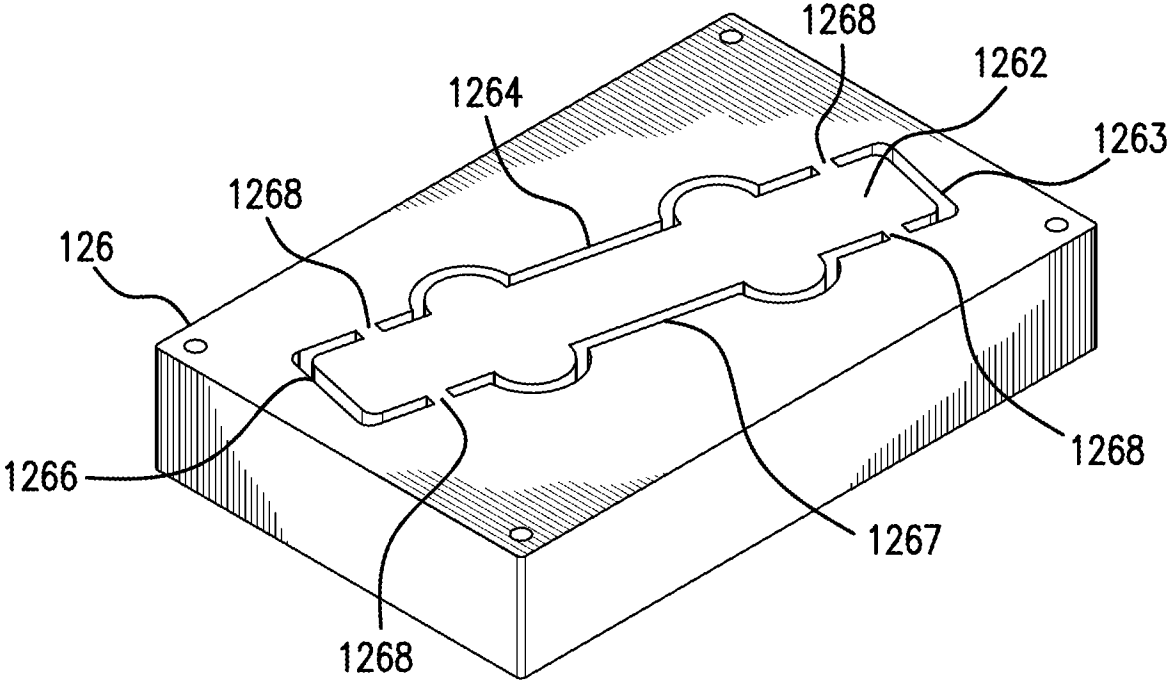
FIG. 9 is a perspective view of a further exemplary pickup transducer receiving block of the present invention.

The pickup transducer receiving block 126 for use with a single pickup transducer is illustrated in FIG. 9. The opening 1265 within which the plug 1262 is formed is angularly oriented so that sensors, such as magnetic coils, at one end of the transducer are longitudinally displaced relative to sensors at the opposing end of the transducer when the pickup transducer receiving block 126 is installed in the receiving cavity 110. The plug 1262 is held within the opening by at least one breakaway tab 1268. In the exemplary embodiment shown, there is a plurality of breakaway tabs 1268 that remain after the perimeter slotted openings 1263, 1264, 1266 and 1267 are formed. The perimeter slotted openings 1263, 1264, 1266 and 1267 are through openings and may be formed using a laser cutting process or by mechanical cutting tools. The one or more breakaway tabs 1268 are formed with a relatively small cross-sectional area to permit the plug 1262 to be easily separated therefrom in the same manner as previously described.

Figure 10:
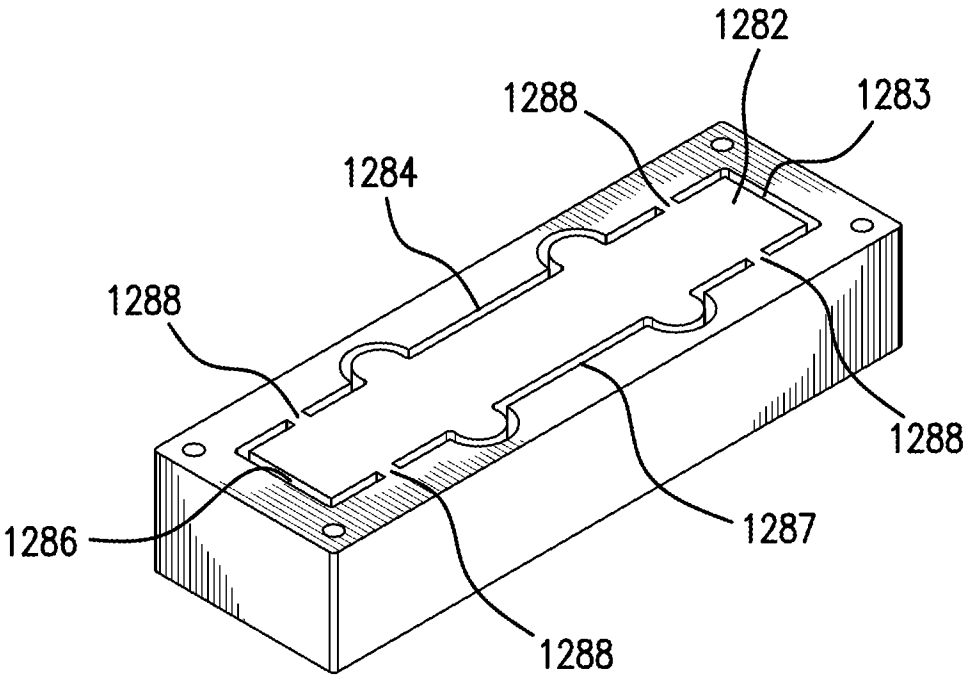
FIG. 10 is a perspective view of an additional exemplary pickup transducer receiving block of the present invention.

As shown in FIG. 10, the pickup transducer receiving block 128 is configured for use with a single pickup transducer. The block is formed with a plug 1282 disposed in the opening 1285 into which the pickup transducer will be installed. The plug 1282 is held within the opening by at least one breakaway tab 1288. In the exemplary embodiment shown, there is a plurality of breakaway tabs 1288 that remain after the perimeter slotted openings 1283, 1284, 1286 and 1287 are formed. The perimeter slotted openings 1283, 1284, 1286 and 1287 are through openings and may be formed using a laser cutting process or by mechanical cutting tools. The one or more breakaway tabs 1288 are formed with a relatively small cross-sectional area to permit the plug 1282 to be easily separated therefrom in the same manner as previously described.

Figure 11:
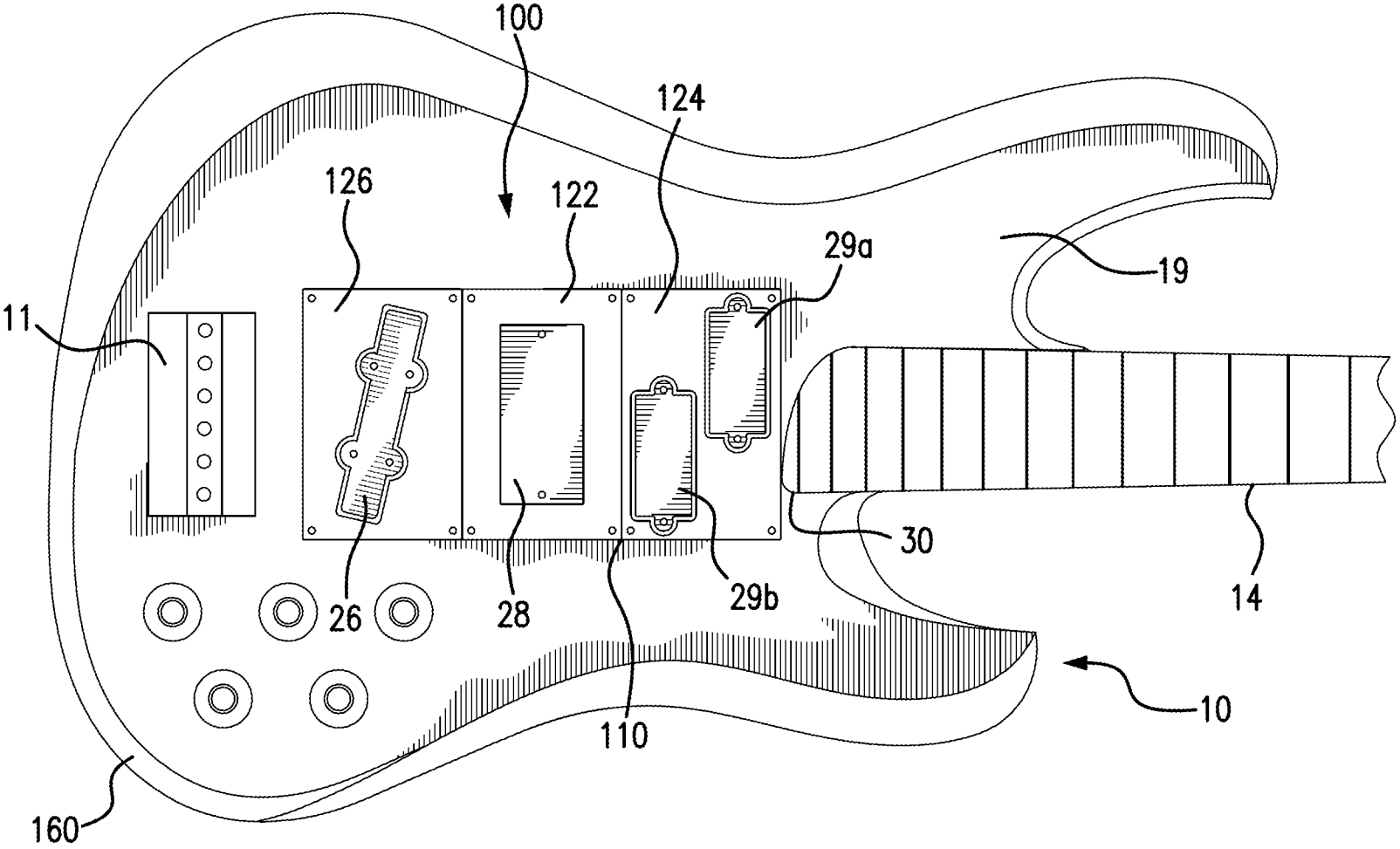
FIG. 11 is an illustration of a string instrument having an instrument body incorporating the present invention with an exemplary pickup transducer configuration installed.
Figure 11A:
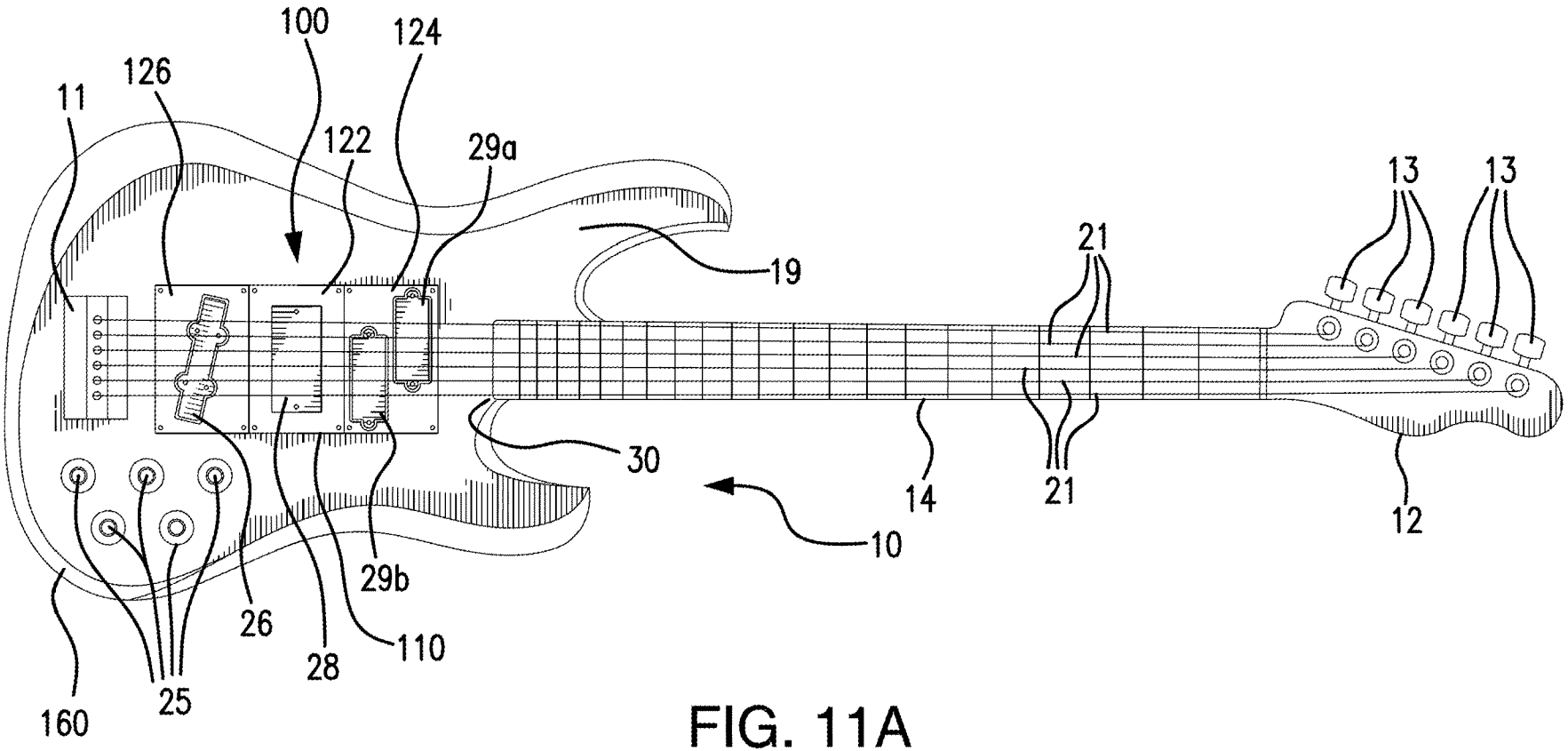
FIG. 11A is an illustration of the string instrument of FIG. 11 as a completed bass guitar.
Figure 12:
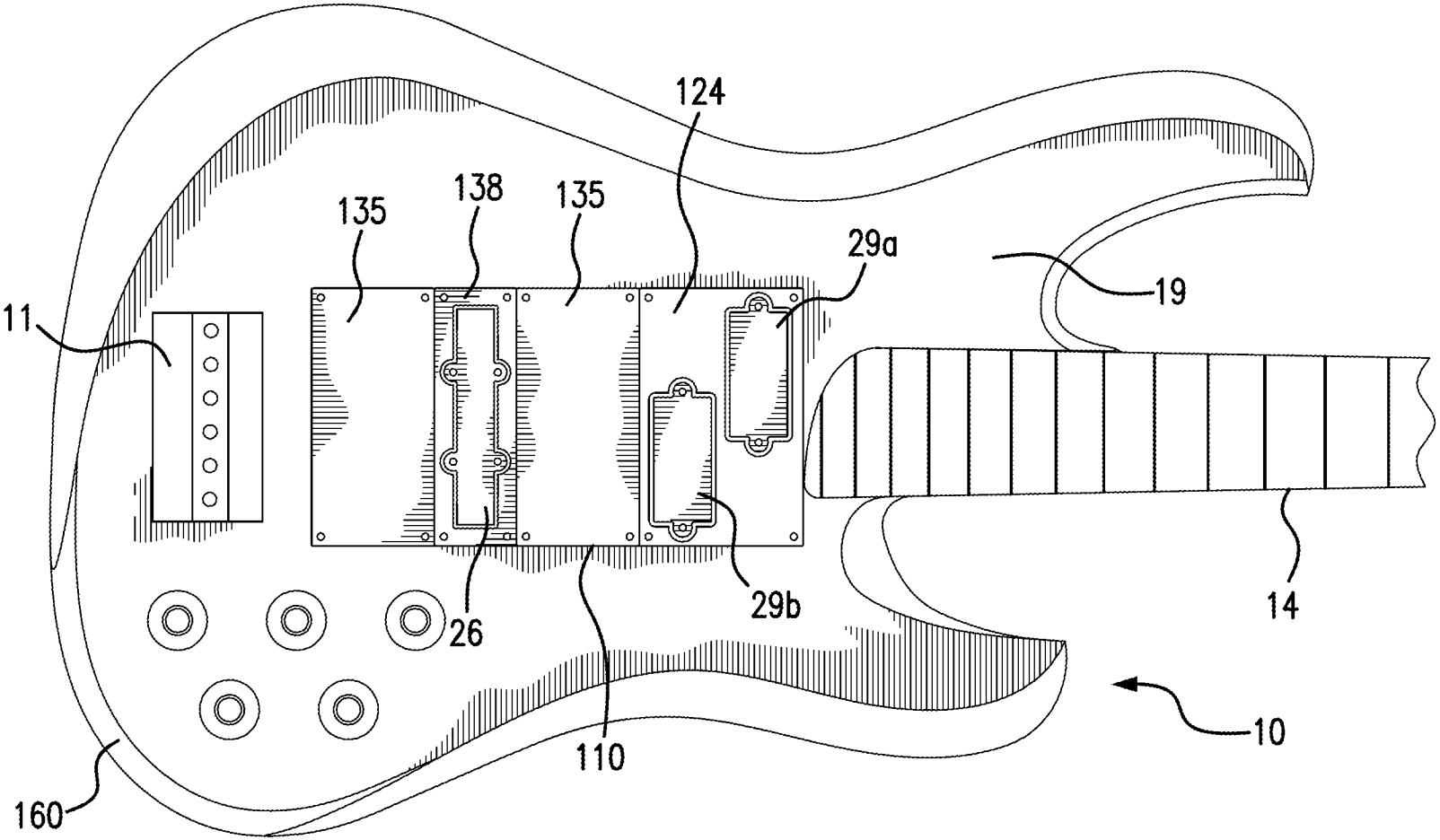
FIG. 12 is an illustration of a string instrument having an instrument body incorporating the present invention of FIG. 11 with the exemplary pickup transducer configuration changed.

In FIG. 11, an exemplary string instrument 10, in this case a bass guitar, is shown having an instrument body 160 that accommodates a receiving cavity that has a longitudinal extent sufficient to accommodate three standard width blocks, which may be any combination of either pickup transducer receiving blocks 120 and spacer blocks 130. In the example shown, the pickup transducer receiving blocks 122, 124 and 126 are installed in the receiving cavity 110. In particular, the pickup transducer receiving block 126, having an angularly oriented single coil pickup transducer 26 mounted therein, is disposed closest to the bridge 11. The pickup transducer receiving block 124, having a pair of offset single coil transducers 29*a* and 29*b* mounted therein, is disposed closest to the proximal end portion 30 of the neck 14. Between the pickup transducer receiving blocks 126 and 124, the pickup transducer receiving block 122 is installed and has a humbucker type pickup transducer 28 mounted therein. The finished bass guitar 10 with strings 21 and controls 25 installed is shown in FIG. 11A.

In FIGS. 12-16, the versatility and interchangeability of universal pickup transducer mounting system 100 is exemplified. Starting with FIG. 12, the plurality of exchangeable body blocks 140 of the string instrument 10 of FIG. 11 are shown reconfigured to include a combination of pickup transducer receiving blocks 124, 128 and spacer blocks 135 installed in the receiving cavity 110. Spacer blocks 135 are medium-large spacer blocks equal to % of a "standard" size block. Where previously the string instrument 10 included single coil transducers 29*a* and 29*b* mounted at the neck end of the receiving cavity 110, an angularly oriented single coil pickup transducer 26 mounted at the bridge end of the receiving cavity 110, and a humbucker type pickup transducer 28 therebetween, the string instrument 10 is now shown to have been reconfigured to include the pair of offset single coil transducers 29*a* and 29*b* mounted at the neck end of the receiving cavity 110, but with only the single coil pickup transducer 26 oriented laterally and spaced from both the bridge end of the receiving cavity 110 and pickup transducer receiving block 124, in which the pair of offset single coil transducers 29*a* and 29*b* are mounted. One of the spacer blocks 135 is disposed between the bridge end of the receiving cavity 110 and the pickup transducer receiving blocks 128 in which the single coil pickup transducer 26 is mounted. Another of the spacer blocks 135 spaces the pickup transducer receiving block 128 from the pickup transducer receiving block 124.

Figure 13:
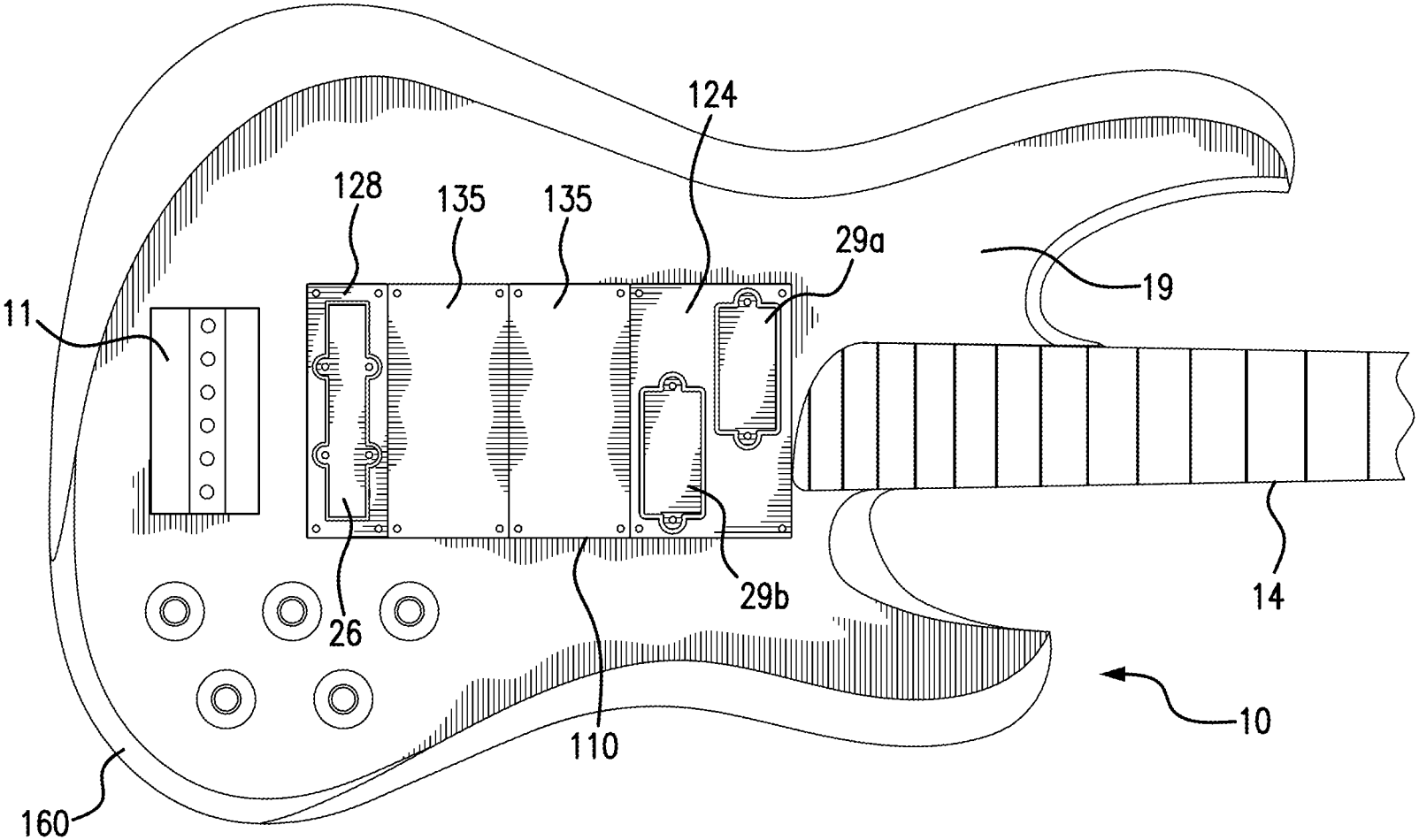
FIG. 13 is an illustration of a string instrument having an instrument body incorporating the present invention of FIG. 11 with the exemplary pickup transducer configuration changed.
Figure 14:
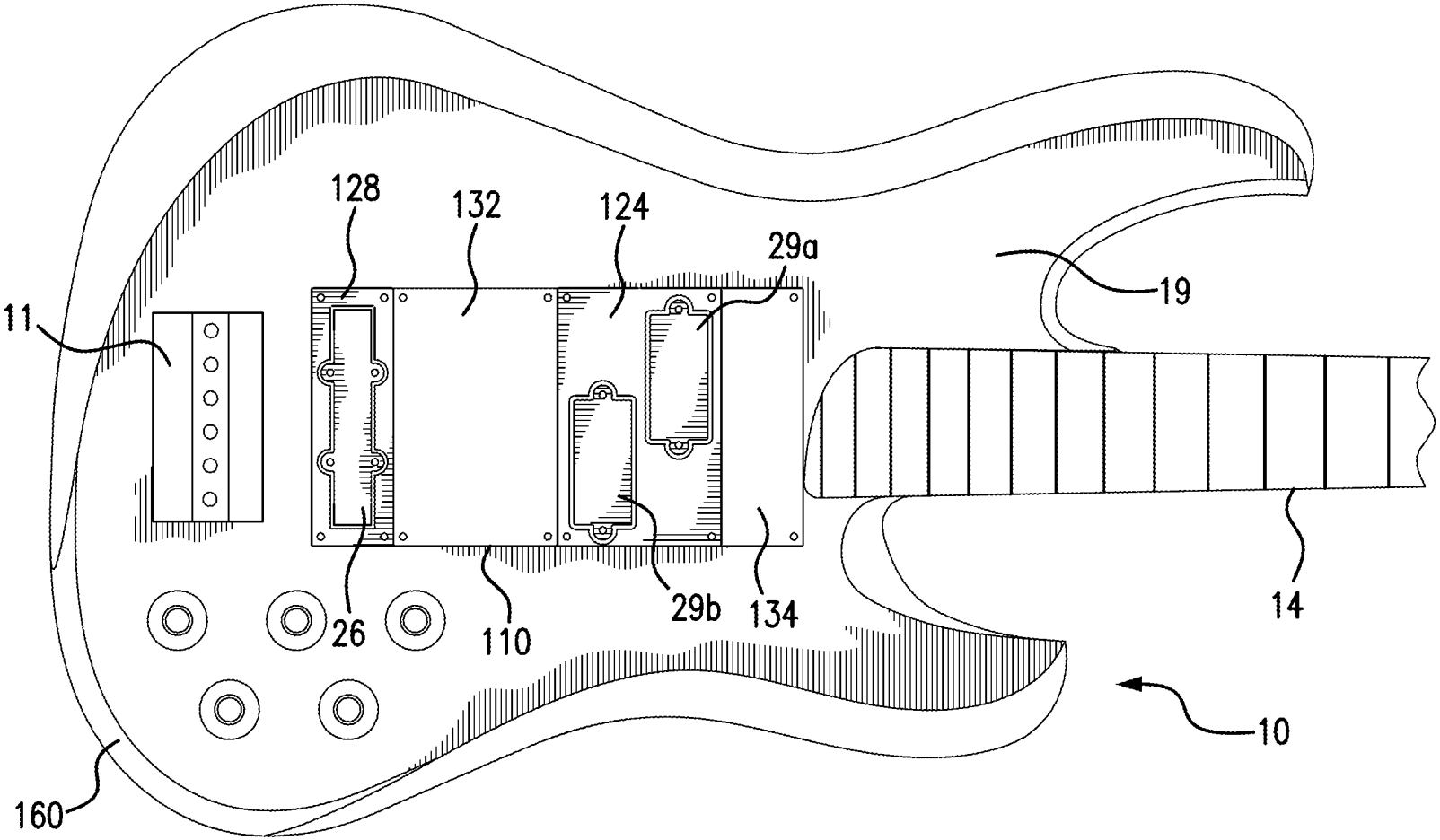
FIG. 14 is an illustration of a string instrument having an instrument body incorporating the present invention of FIG. 11 with the exemplary pickup transducer configuration changed.

FIGS. 13-16 illustrate interchangeability of the locations of the pickup transducer receiving blocks 120 and spacer blocks 130. As shown in FIG. 13, the locations of the spacer block 135 and the pickup transducer receiving block 128 have been interchanged to now position the pickup transducer 26 at the bridge end of the receiving cavity 110. FIG. 14 illustrates reconfiguration of the location of pickup transducers using spacer blocks of different incremental widths. In FIG. 14, the pickup transducer receiving block 124, in which the pair of offset single coil transducers 29*a* and 29*b* are mounted, is spaced from the neck end of the receiving cavity 110 by a medium width spacer block 134 (½ of a "standard" size block). The two spacer blocks 135 that were between the pickup receiving blocks 124 and 128 in the configuration shown in FIG. 13, are now replaced by a single "standard" width spacer block 132. Obviously, further alternative positioning of the pickup transducers between the bridge end of receiving cavity 110 and the neck end of receiving cavity 110 are possible.

Figure 15:
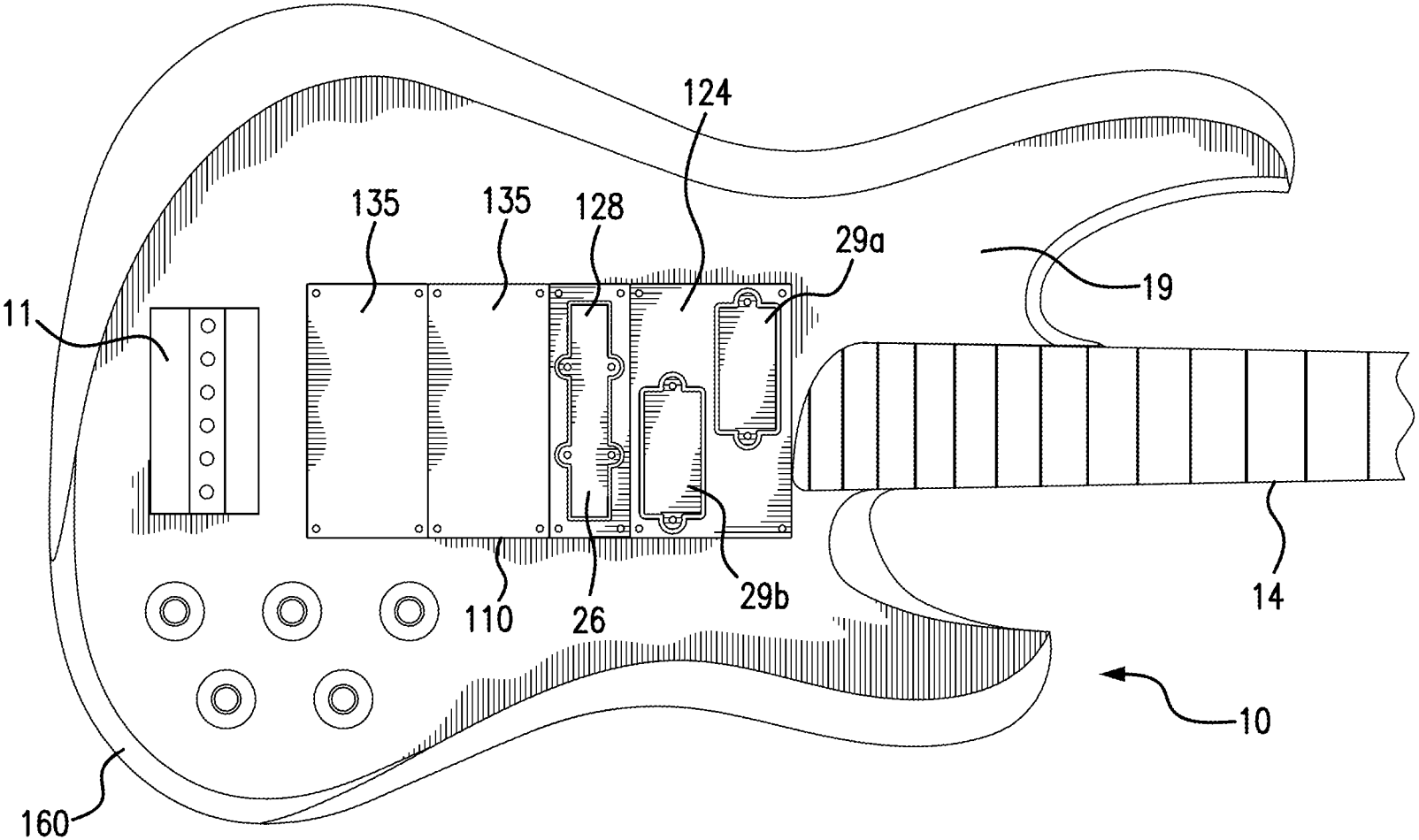
FIG. 15 is an illustration of a string instrument having an instrument body incorporating the present invention of FIG. 11 with the exemplary pickup transducer configuration changed.
Figure 16:
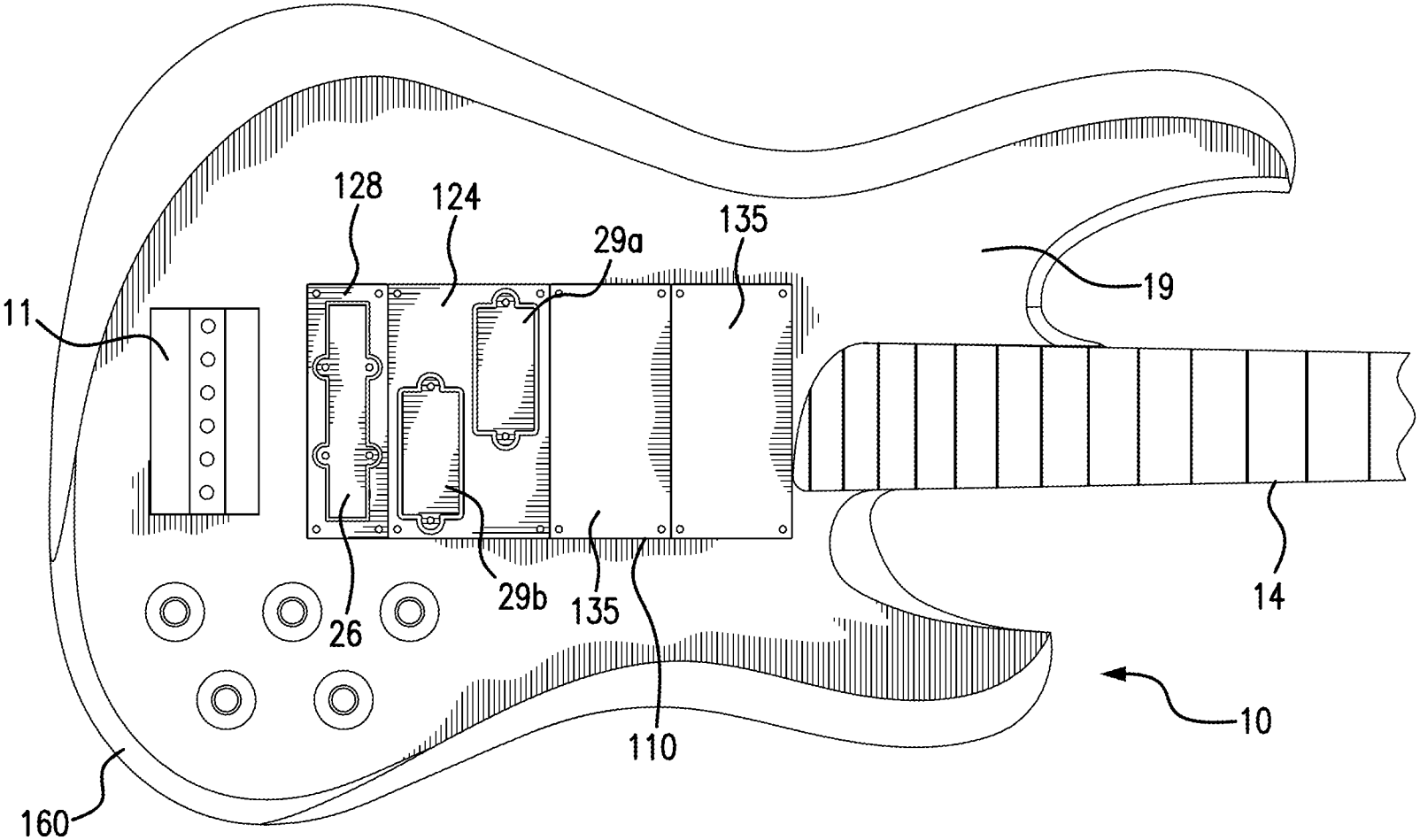
FIG. 16 is an illustration of a string instrument having an instrument body incorporating the present invention of FIG. 11 with the exemplary pickup transducer configuration changed.

In FIG. 15, the pickup transducer receiving block 124, in which the pair of offset single coil transducers 29*a* and 29*b* are mounted, is again located at the neck end of the receiving cavity 110. The pickup transducer receiving block 128, in which the pickup transducer 26 is mounted, has now been relocated to a position directly adjacent to the pickup transducer receiving block 124. The remaining space within the receiving cavity 110 is filed by the pair of medium-large spacer blocks 135. FIG. 16 shows another reconfiguration of the pickup transducers 26 and 29*a*, 29*b*. Pickup transducer receiving block 128, in which the pickup transducer 26 is mounted, has now been relocated to be positioned at the bridge end of receiving cavity 110. The pickup transducer receiving block 124, in which the pair of offset single coil transducers 29*a* and 29*b* are mounted, is directly adjacent to the transducer receiving block 128. The remaining space within the receiving cavity 110, between the pickup transducer receiving block 124 and the neck end of the receiving cavity 110, is filled by the pair of spacer blocks 135, 135. Thus, the positions of the two spacer blocks 135, 135 and the two pickup transducer receiving blocks 128 and 124, as configured in FIG. 15, are interchanged to produce the configuration of FIG. 16.

Advantageously, as the forgoing illustrates, the relative positions of the pickup transducers may subsequently be changed in the finished guitar by simply rearranging the plurality of exchangeable body blocks 140 and/or using spacer blocks 130 of different incremental widths to change the relative spacing of the pickup transducer receiving blocks 120 within the receiving cavity 110. The advantages of system 100 is further demonstrated by the ease an electric string instrument 10 can be adapted to use pickup transducers of different sizes and or types, including transducers using different sensing technologies. The ability to easily use pickup transducers of different sizes, types or sensing technology, makes use of system 100 advantageous for application in an electric string instrument 10 that uses a single pickup transducer receiving block 120 and is encompassed by the inventive concepts disclosed herein.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is being claimed is:

1. A universal pickup transducer mounting system for a string instrument, the string instrument having a body, a longitudinally extended neck having a head at a first end thereof and an opposing second end connected to the body, a bridge affixed to the body at a location longitudinally displaced from the second end of the neck, and a plurality of strings extending between the bridge and head and being laterally spaced one from another, the system comprising:

a receiving cavity formed in the body and extending longitudinally therein between the bridge and the second end of the neck, said receiving cavity being disposed in aligned relationship with the plurality of strings, said receiving cavity having a width at least as wide as a lateral spacing between endmost strings of the plurality of strings and a length defined between opposing longitudinal ends thereof; and a multiplicity of exchangeable body blocks disposed in said receiving cavity and configured for releasable mounting therein and together have a combined longitudinal extent equal to said length of said receiving cavity, said multiplicity of exchangeable body blocks including at least one transducer receiving block having an opening formed therein configured for receiving at least one pickup transducer therein, said at least one transducer receiving block being mountable within said receiving cavity to locate the at least one pickup transducer at a location selectively longitudinally varied in position within said receiving cavity relative to the second end of the neck and the bridge, said multiplicity of exchangeable body blocks further includes a plurality spacer blocks, at least a portion of said plurality of spacer blocks being of different widths than other of said plurality of spacer blocks, said plurality of spacer blocks being configured for filling open space within said receiving cavity left unoccupied by said at least one transducer receiving block.

2. The system as recited in claim 1 where said multiplicity of exchangeable body blocks includes a plurality of transducer receiving blocks, each of said plurality of transducer receiving blocks having at least one opening formed therein configured for receiving at least a respective one of a plurality of different types of pickup transducers, said plurality of transducer blocks being at respective locations selectively longitudinally varied in position relative to the second end of the neck and the bridge and with respect to one another, any of said plurality of transducer receiving blocks being exchangeable with at least one of said plurality spacer blocks of different widths and at least one of said plurality of spacer blocks being exchangeable with one of said plurality of transducer receiving blocks or a combination of one of said plurality of transducer receiving blocks and at least one of said plurality of spacer blocks of different widths.

3. The system as recited in claim 2 where a portion of said plurality of transducer receiving blocks include openings configured for receiving at least one single coil pickup transducer.

4. The system as recited in claim 2 where a portion of said plurality of transducer receiving blocks include openings configured for receiving at least one dual coil type pickup transducer.

5. The system as recited in claim 3 where another portion of said plurality of transducer receiving blocks include openings configured for receiving at least one dual coil type pickup transducer.

6. A method of making a string instrument with a universal pickup transducer mounting system, comprising:

providing an instrument body having a neck mounting portion and a bridge mounting portion at a location longitudinally spaced from the neck mounting portion;

forming a longitudinally extended receiving cavity in the instrument body between the neck and bridge mounting portions;

providing a multiplicity of exchangeable body blocks configured for replaceable mounting within said receiving cavity, the multiplicity of exchangeable body blocks including a plurality of transducer receiving blocks each having at least one opening formed therein for receiving at least one of a plurality of pickup transducers therein, said multiplicity of exchangeable body blocks further including a plurality spacer blocks, at least a portion of said plurality of spacer blocks being of different widths than other of said plurality of spacer blocks;

mounting a selected number of pickup transducers in respective openings of selected transducer receiver blocks of said plurality of transducer receiving blocks; and installing said selected number of said transducer receiving blocks and at least one of said plurality spacer blocks within the receiving cavity, said at least one of said plurality spacer blocks having a selected width to fill at least one longitudinal space within said receiving cavity not occupied by said selected number of transducer receiver blocks and thereby respectively locating said selected number of pickup transducers within the receiving cavity at selectively longitudinally varied positions relative to the neck and bridge mounting portions.

7. The method of claim 6, where the step of providing a multiplicity of exchangeable body blocks is preceded by forming said plurality of transducer receiving blocks with a removable plug portion suspended within said at least one opening thereof by at least a pair of breakaway tabs.

8. The method of claim 6, where the step of installing said selected number of the said transducer receiving blocks and at least one of said plurality spacer blocks includes installing multiple spacer blocks within said receiving cavity respectively between adjacent ones of said selected transducer receiver blocks, between one adjacent pair of said selected transducer receiver blocks and at least one longitudinal end of said receiving cavity, or a combination thereof.

9. A universal pickup transducer mounting system for an electric string instrument, the electric string instrument including an instrument body having a neck extending longitudinally from one end thereof and a bridge affixed to the body at a location longitudinally displaced from the neck, the mounting system comprising a longitudinally extended receiving cavity formed in the instrument body at a location disposed between the neck and the bridge of the electric string instrument, said receiving cavity having a length defined between opposing longitudinal ends thereof, and a multiplicity of exchangeable body blocks configured for removable mounting within said receiving cavity, said multiplicity of exchangeable body blocks including a plurality of transducer receiving blocks configured for receiving at least one type of a plurality of types of pickup transducers within at least one opening formed therein, at least a portion of said plurality of transducer receiving blocks being mounted within said receiving cavity at respective locations selectively longitudinally varied in position relative to the neck and the bridge and relative to one another, said multiplicity of exchangeable body blocks further including a plurality spacer blocks, at least a portion of said plurality of spacer blocks being of different widths than other of said plurality of spacer blocks, said plurality of spacer blocks being configured for filling open space within said receiving cavity left unoccupied by said at least a portion of said plurality of transducer receiving blocks, wherein any of said portion of said plurality of transducer receiving blocks being replaceable with other of said plurality of transducer receiving blocks configured for receiving a different type, number or combination of said type and number of pickup transducers therein, or replaceable with at least one of said plurality of spacer blocks, or replaceable with a combination thereof.

10. The system as recited in claim 9 where said combination of said at least a portion of said plurality of transducer receiving blocks and at least one of said plurality of spacer blocks mounted in said receiving cavity together have a combined longitudinal extent equal to the length of said receiving cavity.

11. The system as recited in claim 9, where said plurality of transducer receiving blocks are formed with a removable plug portion suspended within said at least one opening thereof by at least a pair of breakaway tabs, said plug portion being removed by a user preceding installation of said at least one type of said plurality of types of pickup transducers therein.

12. A universal pickup transducer mounting system for an electric string instrument, the electric string instrument having an instrument body, a neck extending longitudinally from the instrument body and a bridge affixed to the instrument body at a location longitudinally displaced from the neck, the mounting system comprising a longitudinally extended cavity formed in the instrument body between the neck and the bridge, and multiplicity of exchangeable body blocks configured for mounting within said receiving cavity at respective locations selectively longitudinally varied in position relative to the neck and the bridge and relative to one another, said multiplicity of exchangeable body blocks including a plurality of transducer receiving blocks each configured for receiving at least one of a plurality of different types of pickup transducers within at least one opening formed therein, and a plurality of spacer blocks, a combination of at least one of said plurality of transducer receiving blocks and at least one of said plurality of spacer blocks being mounted within said cavity, wherein any of said plurality of exchangeable body blocks are at least replaceable with other of said exchangeable body blocks to change at least one of a type of pickup transducer disposed in said cavity, a number of said pickup transducers, a longitudinal position of at least one of said pickup transducers relative to said bridge and a proximal end portion of the neck, or a combination thereof.

13. The system as recited in claim 12 where said plurality of spacer blocks include spacer blocks of different widths than widths of other spacer blocks.

* * * * *